US011109132B2

(12) United States Patent
Yan et al.

(10) Patent No.: US 11,109,132 B2
(45) Date of Patent: Aug. 31, 2021

(54) SCREEN SOUND GENERATION DEVICE

(71) Applicant: AAC Technologies Pte. Ltd., Singapore (SG)

(72) Inventors: Xudong Yan, Shenzhen (CN); Wei Liu, Shenzhen (CN); Keyong Zhou, Shenzhen (CN); Pengfei Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/945,928

(22) Filed: Aug. 2, 2020

(65) Prior Publication Data

US 2021/0006880 A1 Jan. 7, 2021

Related U.S. Application Data

(63) Continuation of application No. PCT/CN2019/094147, filed on Jul. 1, 2019.

(51) Int. Cl.

| | |
|---|---|
| ***H04R 1/02*** | (2006.01) |
| ***H04R 9/06*** | (2006.01) |
| ***H04R 9/04*** | (2006.01) |
| ***H04R 9/02*** | (2006.01) |
| ***H04R 7/04*** | (2006.01) |

(52) U.S. Cl.

CPC ..... *H04R 1/028* (2013.01); *H04R 1/025* (2013.01); *H04R 7/045* (2013.01); *H04R 9/025* (2013.01); *H04R 9/04* (2013.01); *H04R 9/063* (2013.01); *H04R 2440/05* (2013.01); *H04R 2499/11* (2013.01); *H04R 2499/15* (2013.01)

(58) Field of Classification Search

CPC ..... H04R 1/025; H04R 1/028; H04R 5/02; H04R 7/045; H04R 9/025; H04R 9/04; H04R 9/063; H04R 11/02; H04R 2440/05; H04R 2499/11; H04R 2499/15

See application file for complete search history.

(56) References Cited

U.S. PATENT DOCUMENTS

| | | | | |
|---|---|---|---|---|
| 4,514,599 A * | 4/1985 | Yanagishima | ..... | H04R 1/24 381/152 |
| 7,817,810 B2 * | 10/2010 | Cheung | ..... | H04R 31/00 381/152 |
| 2020/0128330 A1 * | 4/2020 | Nam | ..... | H04R 5/02 |

* cited by examiner

*Primary Examiner* — Huyen D Le
(74) *Attorney, Agent, or Firm* — W&G Law Group LLP

(57) ABSTRACT

A screen sound generation device includes a screen configured for vibrating and generating sound, an exciter configured for driving the screen to vibrate and generate sound, and a middle frame configured for receiving and fixing the screen and the exciter. The vibration direction of the exciter is perpendicular to the screen. The screen sound generation device further includes a fixing part by which the exciter is detachably fixed to a side of the screen. The fixing part includes a limit block with a threaded hole therein and a steel sheet attached to the screen, the limit block is fixed to the steel sheet, and the exciter is fixed to the steel sheet by a connecting structure with threads. The screen sound generation device according to the present disclosure provides a flexible assembly method, a reduced difficulty of assembly and an improved working efficiency.

11 Claims, 13 Drawing Sheets

SCREEN SOUND GENERATION DEVICE

FIELD OF THE INVENTION

The present disclosure relates to the field of electro-acoustic transducers, and in particular to a screen sound generator.

BACKGROUND

With the advent of the Internet era, more and more electronic devices, including mobile phones that are easy to carry, are gradually occupying people's daily life. At present, the mobile phones are providing more and more diverse functions, including high-quality music functions. In this regard, providing speakers for the mobile phones is one of the necessary conditions for achieving high-quality music functions. At present, the mobile phones on the market generally use electromagnetic speakers to realize the music play function, but such electromagnetic speakers make the mobile phone have a complicated structure and occupy the internal space of the mobile phone.

With the development of touch screen mobile phones, in order to save the internal space of mobile phones, screen sound generators have also begun to be applied to smart phones so as to provide screen sound generation smart phones, so that the user can hear a high-quality sound when putting his/her ear close to the screen, which is convenient for answering with a clearer sound effect while displaying pictures on the screen. In this regard, an exciter is a key component for realizing the screen sound generation.

In the related art, the exciter composed of a magnetic circuit system requires the screen to withstand a large suction force, and thus there is a high requirement for assembling the exciter on the screen. Also, the exciter has a high cost and is easy to be damaged, which greatly increases the difficulty of assembly.

Therefore, it is necessary to provide an improved screen sound generation device in order to solve at least one of the above problems.

SUMMARY

The main technical problem solved by the present disclosure is that when an exciter is installed on a screen, a design of high-efficiency magnetic circuit requires the screen to withstand a great suction force, which brings a higher requirement on the assembly of the screen and a middle frame and reduces reliability and assembleability of the screen.

The present disclosure provides a screen sound generation device which comprises a screen configured for vibrating and generating sound; an exciter configured for driving the screen to vibrate and generate sound, a vibration direction of the exciter being perpendicular to the screen; and a middle frame configured for receiving and fixing the screen and the exciter. The screen sound generation device further comprises a fixing part by which the exciter is detachably fixed to a side of the screen. The fixing part comprises a limit block with a threaded hole therein and a steel sheet attached to the screen, the limit block is fixed to the steel sheet, and the exciter is fixed to the steel sheet by a connecting structure with threads.

In some embodiment, the steel sheet is fixed to the screen by double-sided adhesive or liquid adhesive.

In some embodiment, the limit block is fixed to the steel sheet by welding or bonding.

In some embodiment, the exciter comprises a yoke with a first installation hole defined at each end thereof, the middle frame comprises a notch for providing an access to the steel sheet and a second installation hole defined at a periphery of the notch and corresponding to the first installation hole, the exciter is received in the notch, and the yoke is fixed to the middle frame at each end by a nut.

In some embodiment, the middle frame comprises a limit plate with a mounting opening, and a third installation hole is defined at a periphery of the mounting opening for fixing the exciter.

In some embodiment, the exciter comprises a yoke with a fourth installation hole defined at each end thereof and corresponding to the third installation hole, and the exciter is fixed to the limit plate by a nut.

In some embodiment, the middle frame is provided with a through opening having a height greater than that of the limit plate.

In some embodiment, the limit plate comprises a bottom plate, side plates extending perpendicularly from opposite sides of the bottom plate to form an end opening, and an extension plate extending perpendicularly from a free end of each side plate in a direction away from the opening.

In some embodiment, the middle frame comprises a limit step, the steel sheet is placed in the through opening to form a receiving space, the limit step is received in the receiving space.

In some embodiment, the limit step has a height equal to that of the side plates.

In some embodiment, the extension plate is further provided with a fifth mounting hole, the limit step is provided with a sixth mounting hole corresponding to the fifth mounting hole, and the limit plate and the middle frame are fixed together by a nut engaged in the fifth mounting hole and the sixth mounting hole.

The screen sound generation device according to the present disclosure is fixed on the screen by a detachable fixing part such that a flexible assembly method is obtained, the difficulty of assembly is reduced, and the working efficiency is improved, and the structural integrity of the entire exciter in assembly can be ensured so as to avoid damage, thereby ensuring the quality of the sound generation device.

BRIEF DESCRIPTION OF THE DRAWINGS

In order to explain the technical solutions of the embodiments of the present disclosure more clearly, accompanying drawings used to describe the embodiments are briefly introduced below. It is evident that the drawings in the following description are only concerned with some embodiments of the present disclosure. For those skilled in the art, in a case where no inventive effort is made, other drawings may be obtained based on these drawings.

DESCRIPTION OF THE EMBODIMENTS

The technical solutions in embodiments of the present disclosure will be clearly and completely described with reference to the accompanying drawings of the present disclosure. It is evident that the elements described are only some rather than all embodiments of the present disclosure. Based on the embodiments of the present disclosure, all other embodiments obtained by those skilled in the art without making any inventive effort fall into the protection scope of the present disclosure.

Embodiment 1

Figure 1:
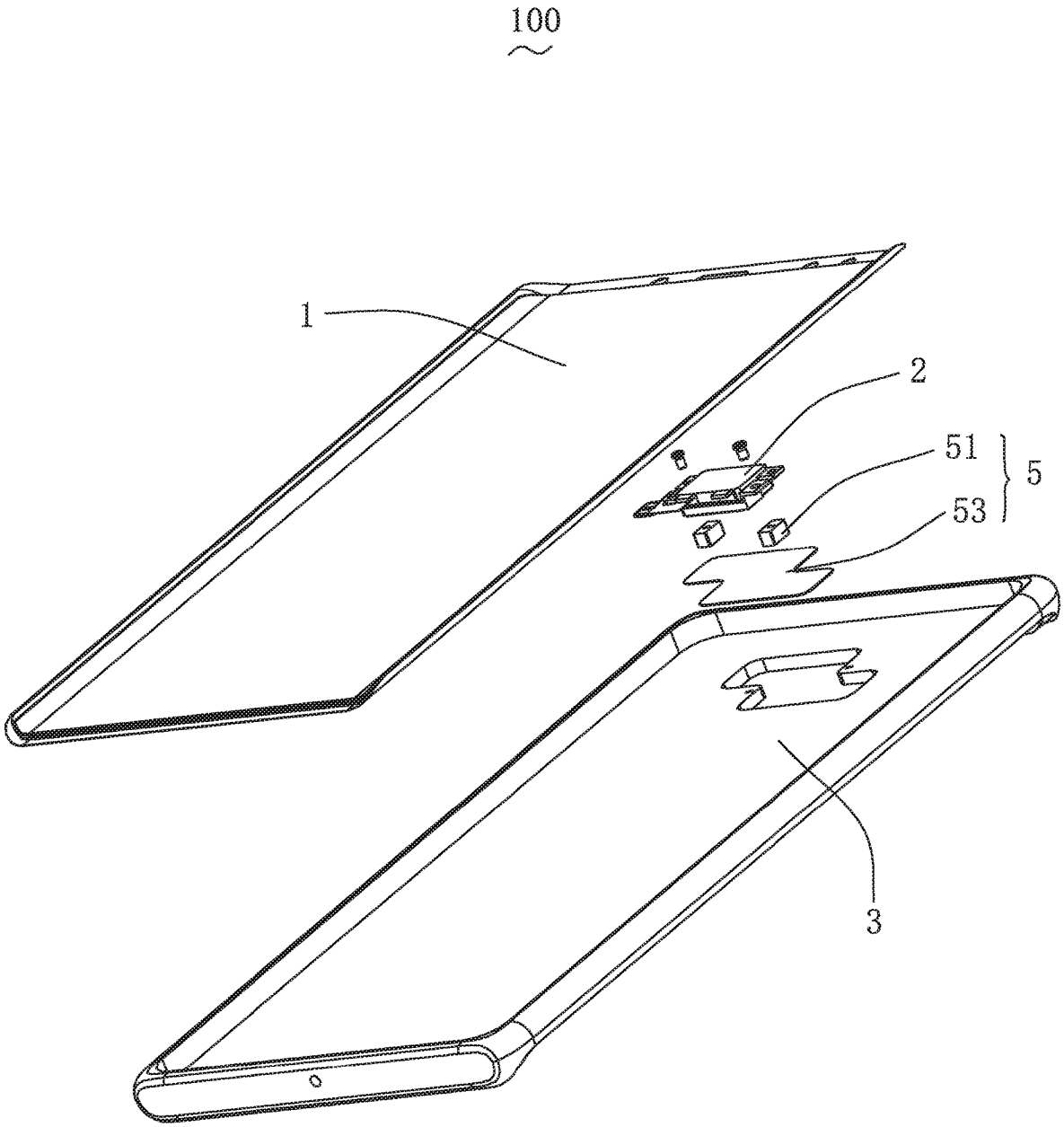
FIG. 1 is an exploded schematic view of a screen sound generation device provided in Embodiment 1.
Figure 4:
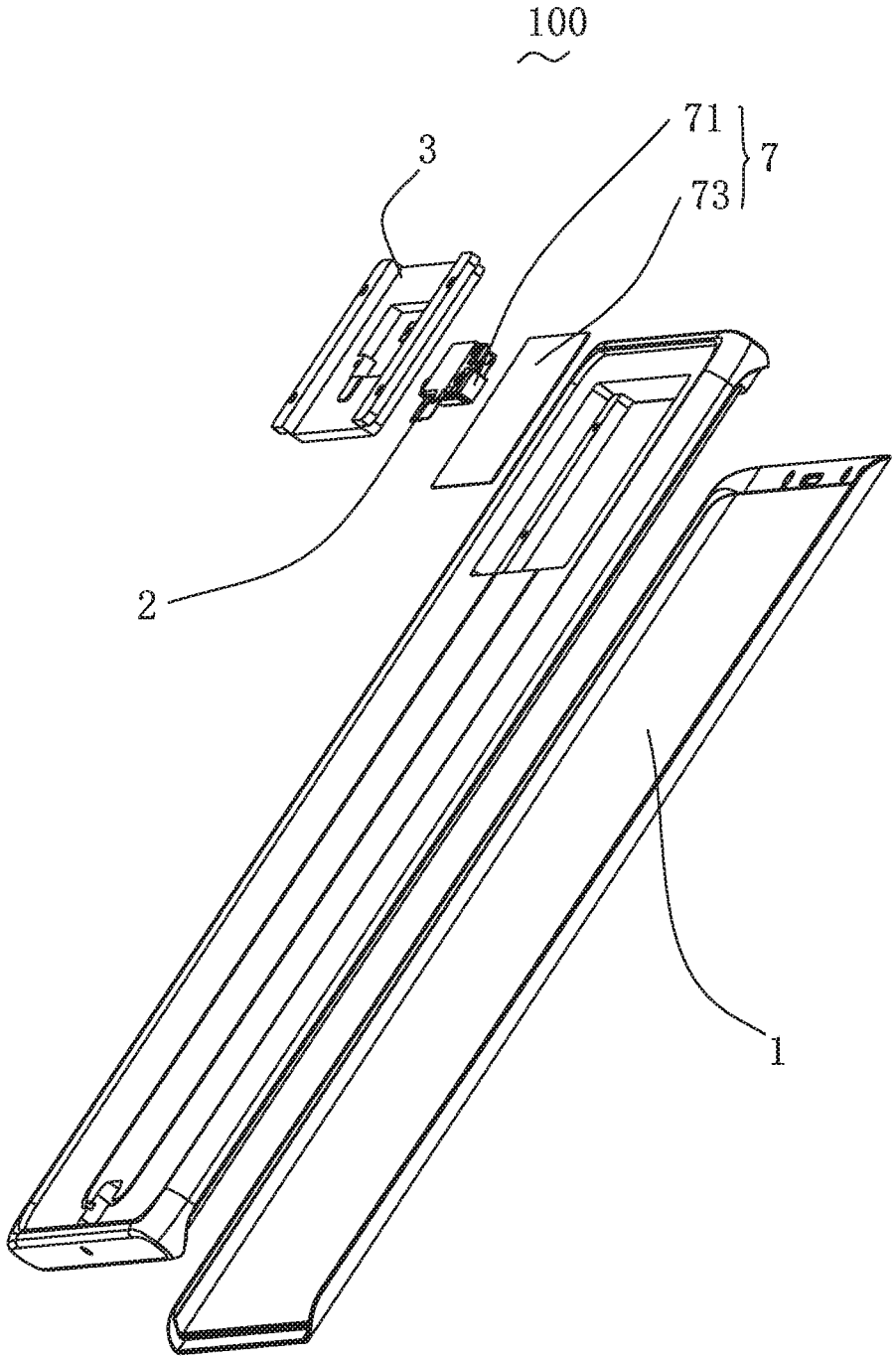
FIG. 4 is an exploded schematic view of the screen sound generation device provided in Embodiment 2.
Figure 8:
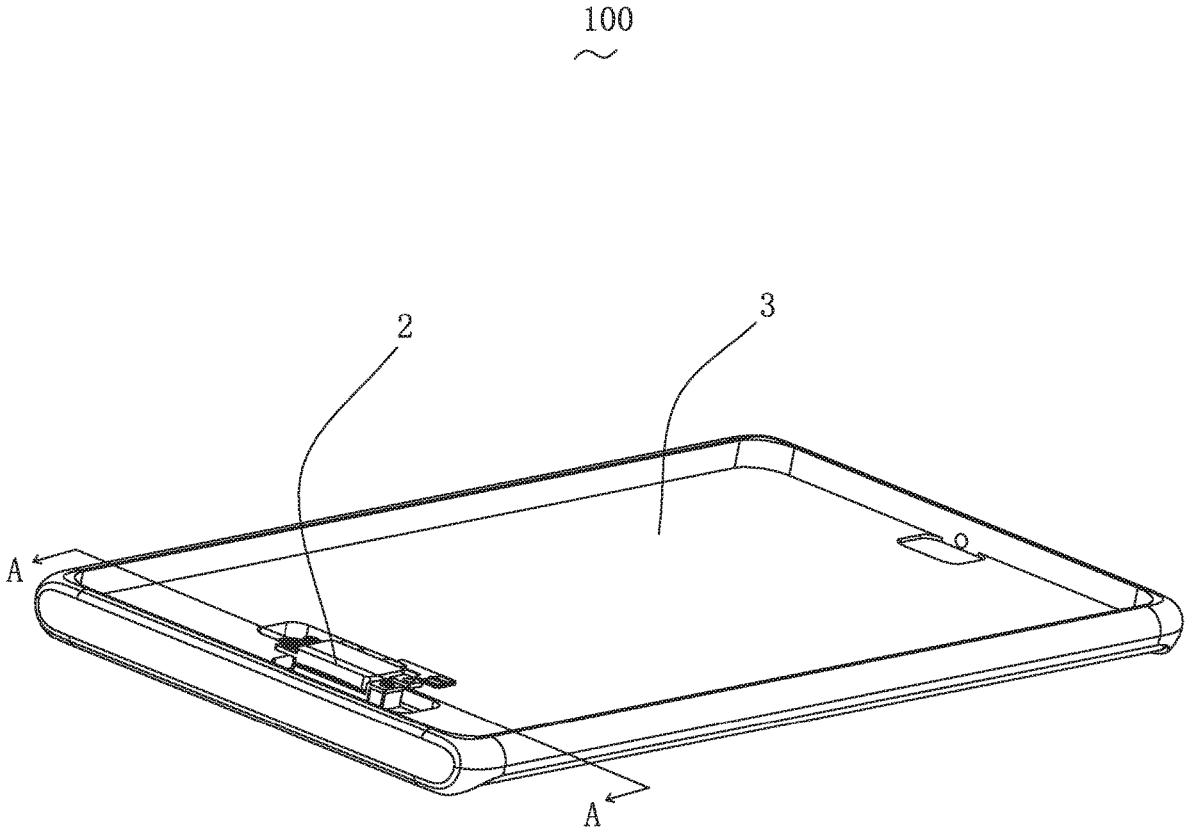
FIG. 8 is a perspective structural schematic view of the screen sound generation device provided in Embodiment 1.
Figure 9:
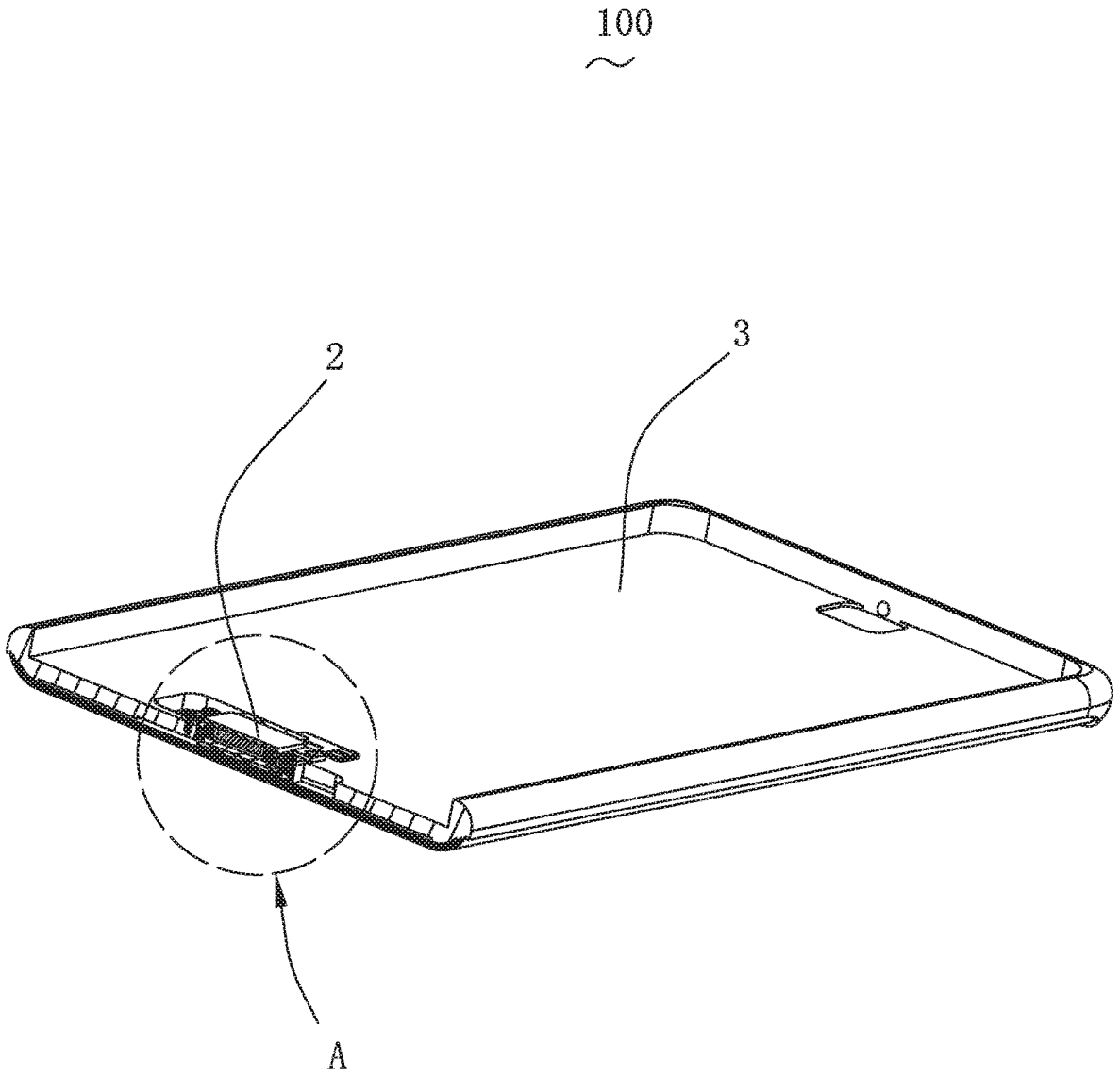
FIG. 9 is a cross-sectional view taken along a line A-A of FIG. 8.
Figure 10:
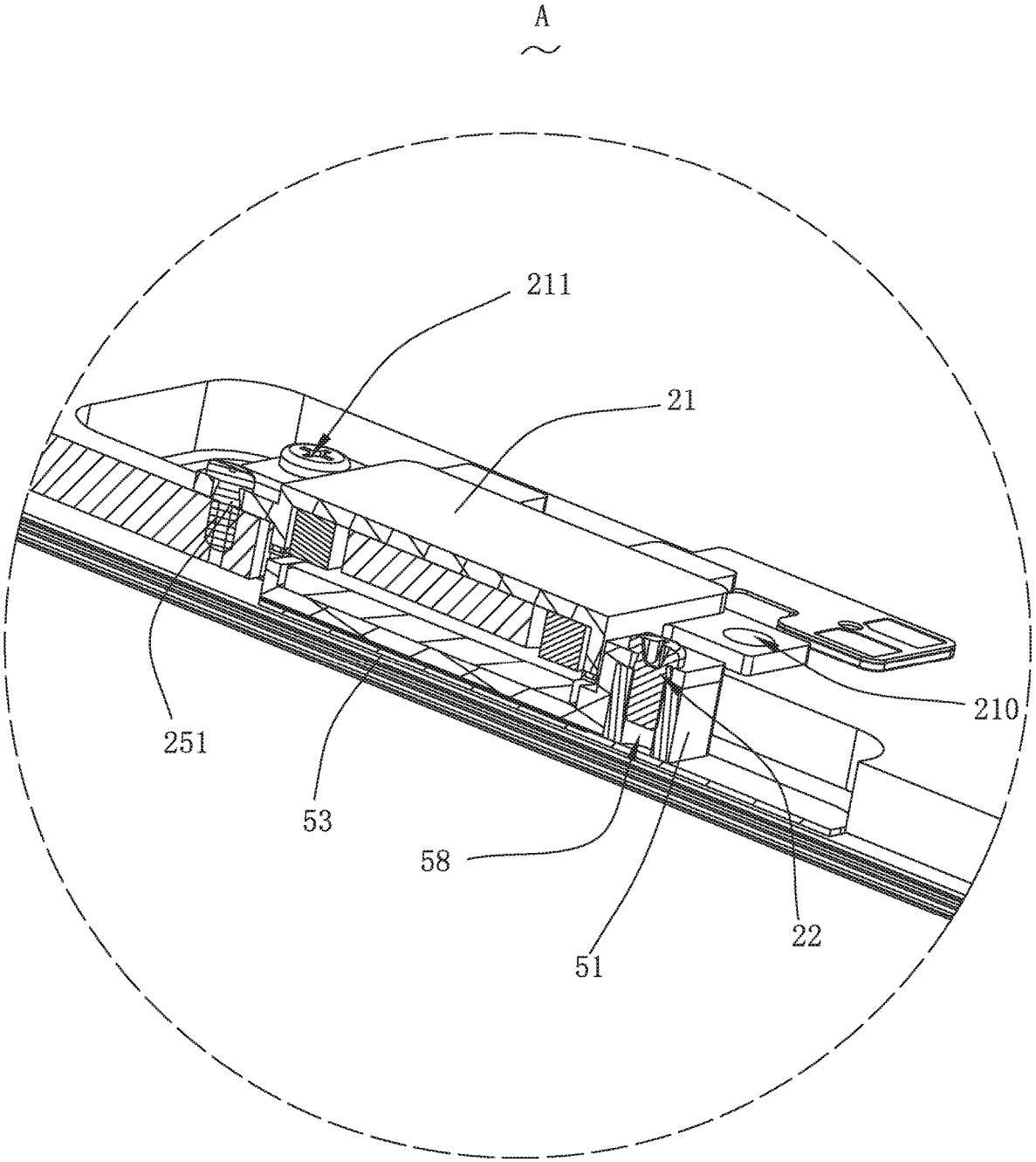
FIG. 10 is an enlarged view of the circle marked in FIG. 9.

FIG. 1 is an exploded schematic view of a screen sound generation device provided in Embodiment 1, FIG. 4 is an exploded schematic view of a screen sound generation device provided in Embodiment 2, FIG. 8 is a perspective structural schematic view of the screen sound generation device provided in Embodiment 1, FIG. 9 is a cross-sectional view taken along a line A-A of FIG. 8, and FIG. 10 is an enlarged view of the circle marked in FIG. 9. Referring to FIG. 1, FIG. 4, FIG. 8, FIG. 9 and FIG. 10 together, the screen sound generation device 100 includes a screen 1 for vibrating and generating sound, an exciter 2 for driving the screen 1 to vibrate and generate sound, and a middle frame 3 for receiving and fixing the screen 1 and the exciter 2. The exciter 2 has a vibration direction perpendicular to the screen 1. The screen sound generation device 100 further includes a fixing part 5 by which the exciter 2 is detachably fixed to a side of the screen 1.

Figure 2:
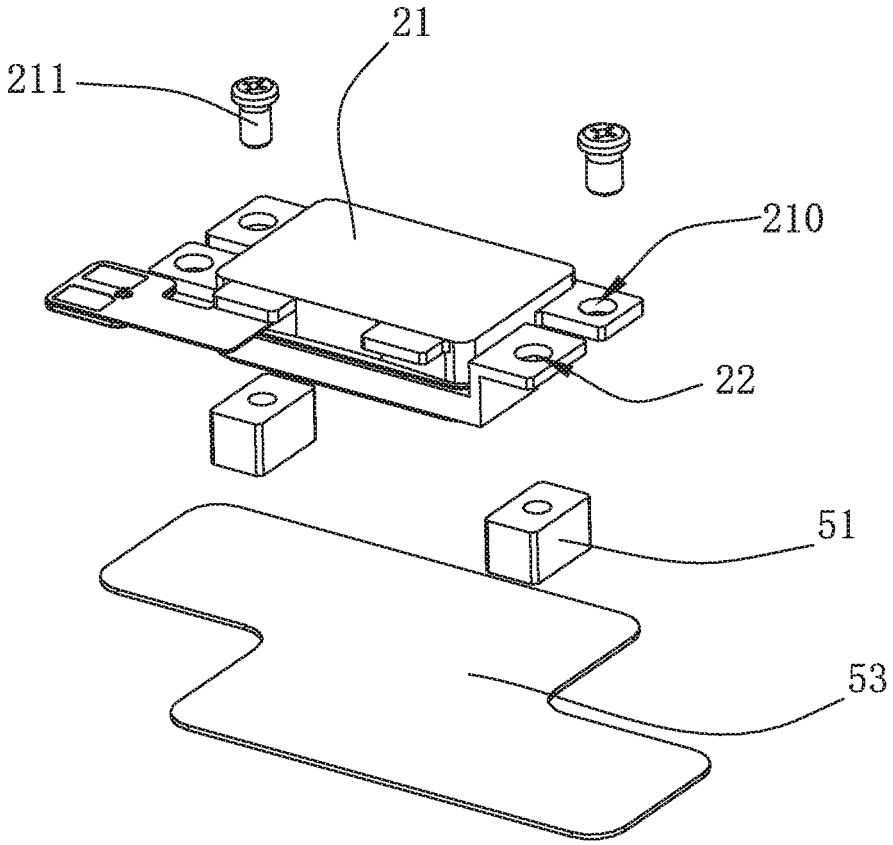
FIG. 2 is a structural schematic view of an exciter and a fixing part in the screen sound generation device provided in Embodiment 1.

FIG. 2 is a structural schematic view of the exciter and the fixing part in the screen sound generation device provided by this embodiment. Referring to FIG. 2, the fixing part 5 includes a limit block 51 with a threaded hole 58 therein and a steel sheet 53 attached to the screen. The limit block 51 is fixed to the steel sheet 53 by welding or bonding and the exciter 2 is fixed to the steel sheet 53 by a connecting structure with threads. In this embodiment, the connecting structure with threads includes the threaded hole of the limit block 51, a nut 251, and an installation hole 22 provided in the exciter 2 and corresponding to the threaded hole.

The steel sheet 53 is fixed to the screen 1 by double-sided adhesive or liquid adhesive.

Figure 3:
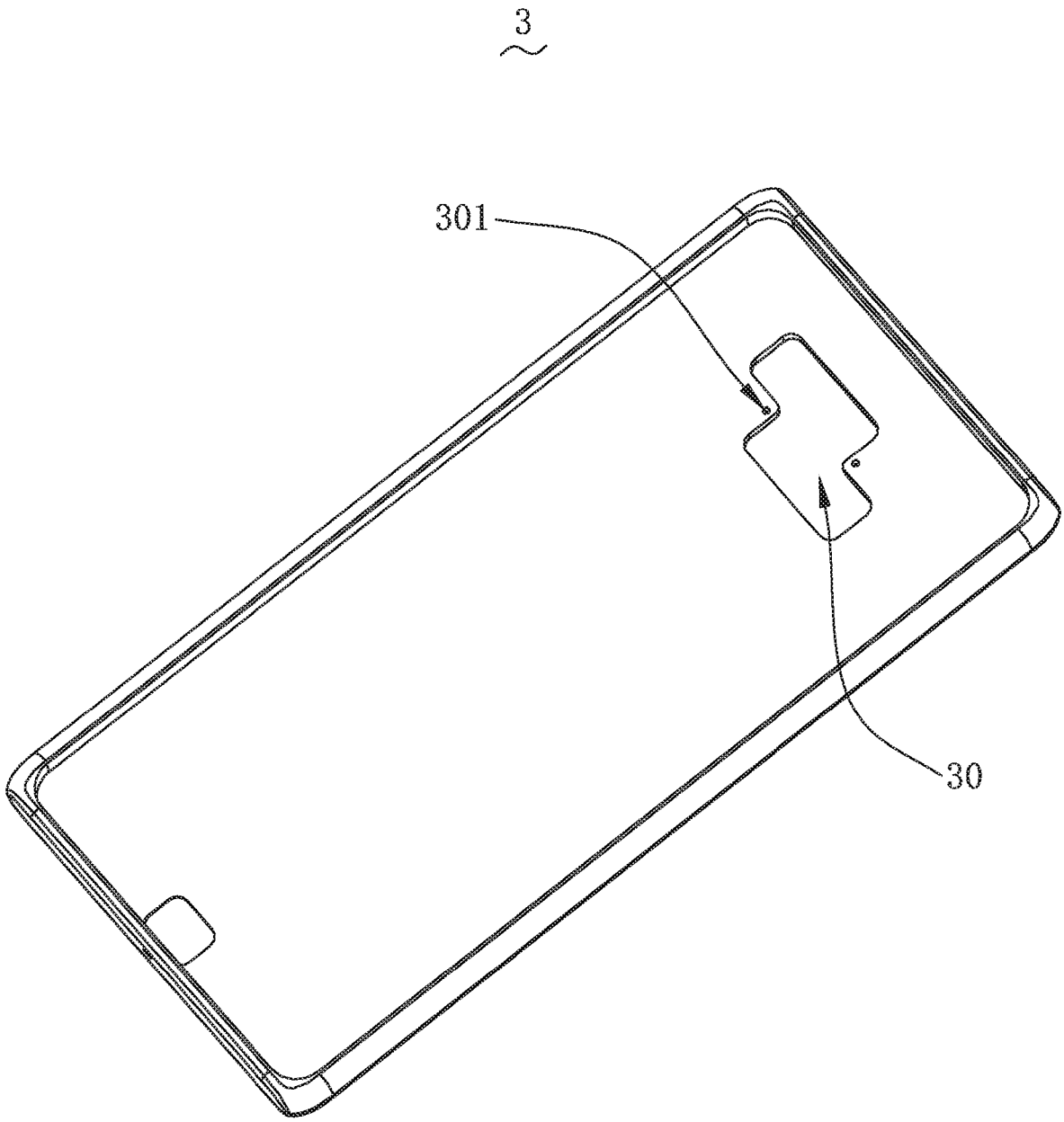
FIG. 3 is a structural schematic view of a middle frame in the screen sound generation device provided in Embodiment 1.

FIG. 3 is a structural schematic view of the middle frame in the screen sound generation device provided by this embodiment. Referring to FIG. 2 and FIG. 3 together, the exciter 2 includes a yoke 21 provided with a first installation hole 210 at each end. The middle frame 3 includes a notch 30 for providing an access to the steel sheet 53 and a second installation hole 301 defined at the periphery of the notch 30 and corresponding to the first installation hole 210. The exciter 2 is received in the notch 30. The yoke 21 is fixed to the middle frame 3 at each end thereof by a nut 211.

Embodiment 2

Figure 5:
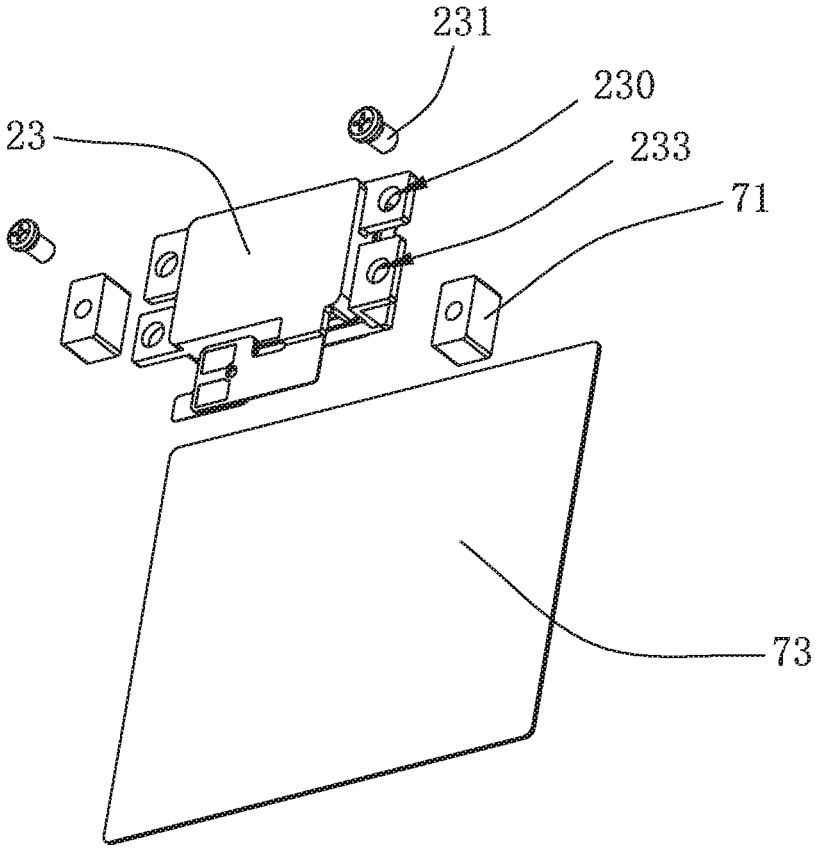
FIG. 5 is a structural schematic view of an exciter and a fixing part in the screen sound generation device provided in Embodiment 2.

Referring to FIG. 5 which is a structural schematic view of the exciter and the fixing part in the screen sound generation device provided by this embodiment, the fixing part 7 includes a limit block 71 with a threaded hole 78 and a steel sheet 73. The limit block 71 is fixed to the steel sheet 73 by welding or bonding, and the exciter 2 is fixed to the steel sheet 73 by a connecting structure with threads. In this embodiment, the connecting structure with threads includes the threaded hole 78 of the limiting block 71, a nut 231, and an installation hole 233 defined in the exciter and corresponding to the threaded hole 78.

The steel sheet 73 is fixed to the screen 1 by double-sided adhesive or liquid adhesive.

Figure 6:
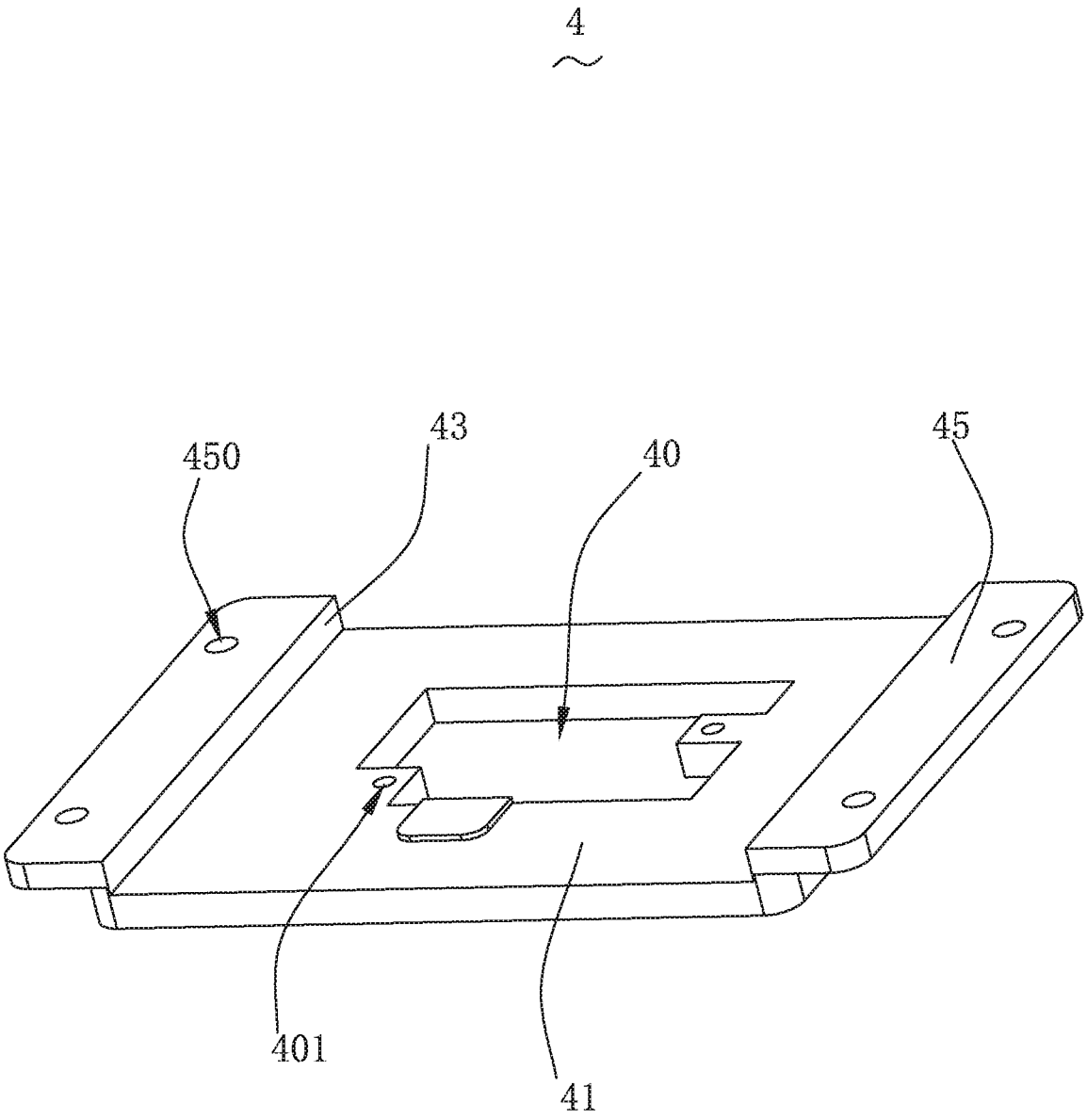
FIG. 6 is a structural schematic view of a limit plate in the screen sound generation device provided in Embodiment 2.

Referring to FIG. 6, which is a structural schematic view of a limit plate in the screen sound generation device provided by this embodiment. The middle frame 3 further includes a limit plate 4 with a mounting opening 40, and third installation holes 401 are defined at the periphery of the mounting opening 40 for fixing the exciter 2. The exciter 2 includes a yoke 23 with a fourth installation hole 230 defined at each end thereof and corresponding to the third installation hole 401, and the exciter is fixed to the limit plate 4 by a nut.

The limit plate 4 includes a bottom plate 41, side plates 43 extending perpendicularly from opposite sides of the bottom plate 41. The bottom plate 41 and the side plate 43 cooperatively form a space with an opening 410. The limit plate 4 further includes an extension plate 45 extending from a free end of each side plate 43 in a direction away from the opening 410.

Figure 7:
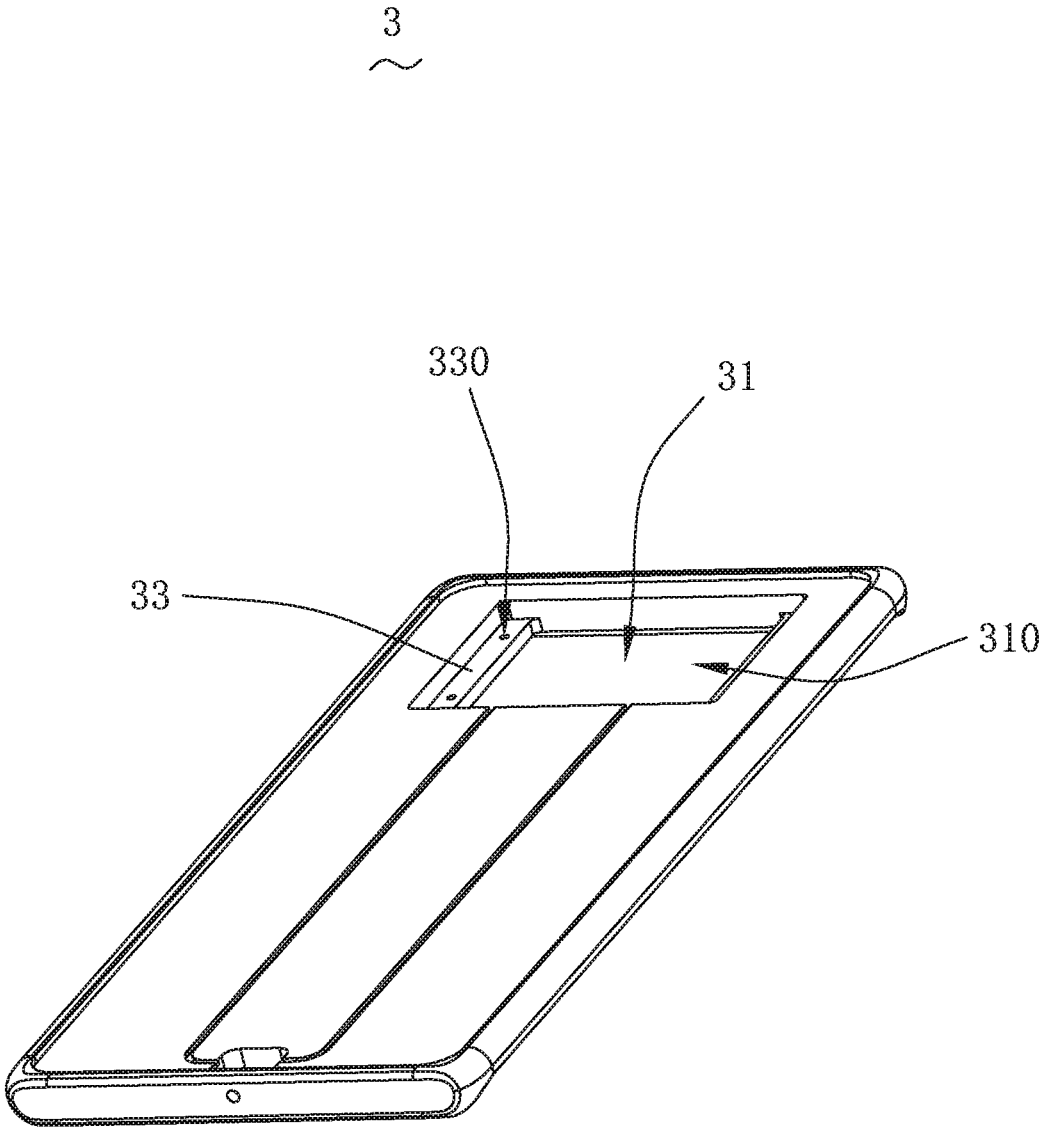
FIG. 7 is a structural schematic view of a middle frame in the screen sound generation device provided in Embodiment 2.
Figure 11:
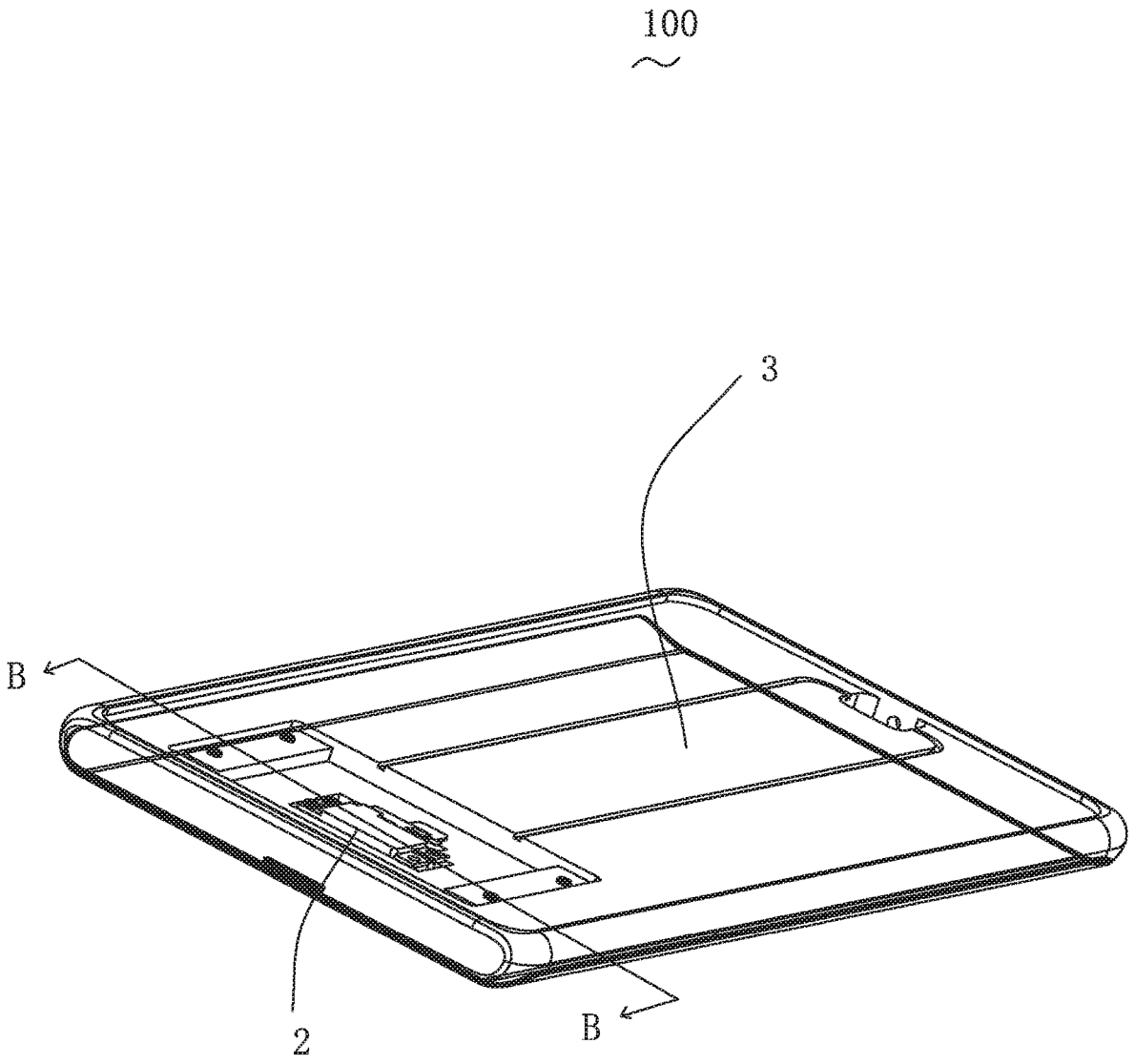
FIG. 11 is a perspective structural schematic view of the screen sound generation device provided in Embodiment 2.
Figure 12:
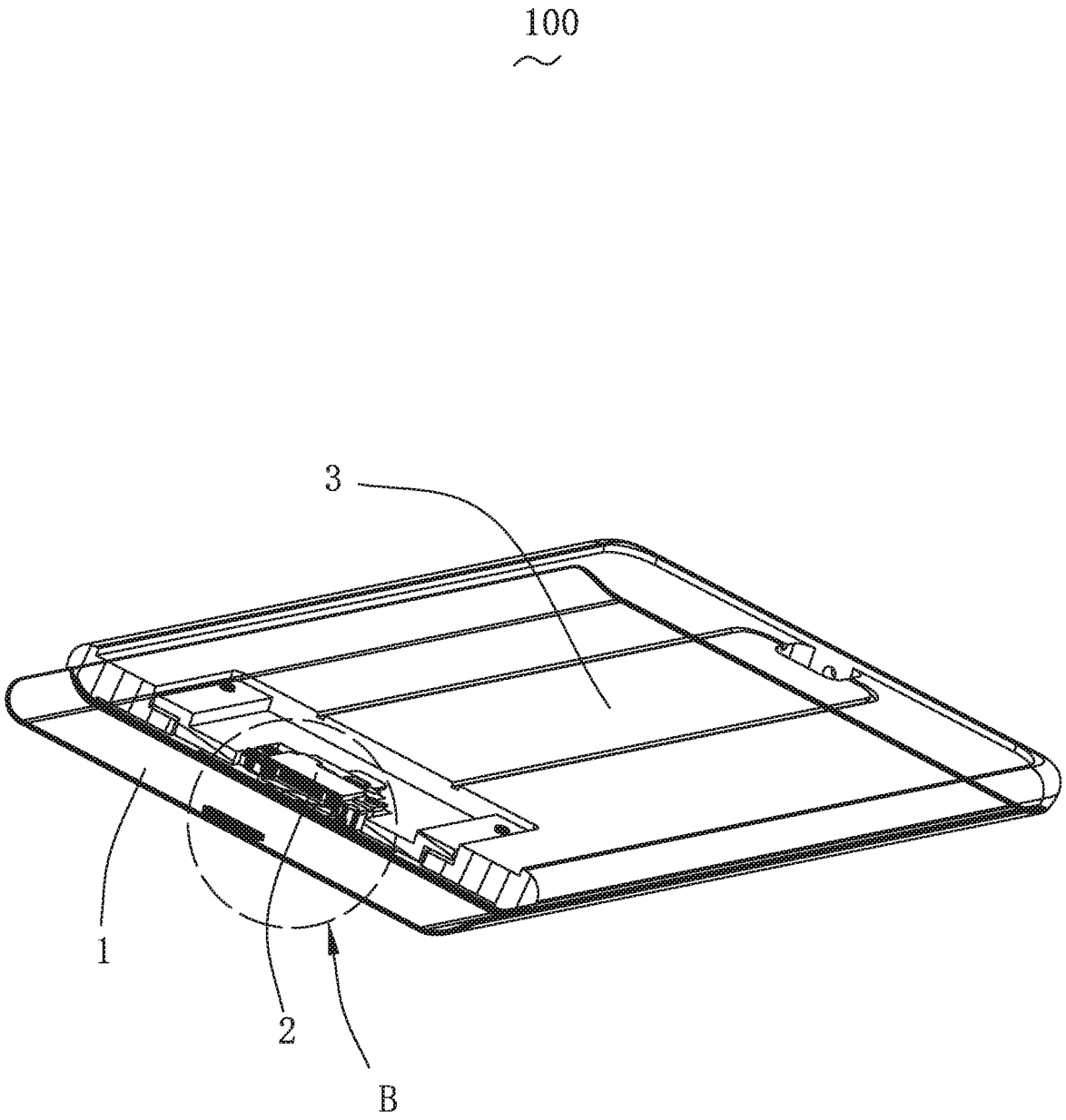
FIG. 12 is a cross-sectional view taken along a line B-B of FIG. 10.
Figure 13:
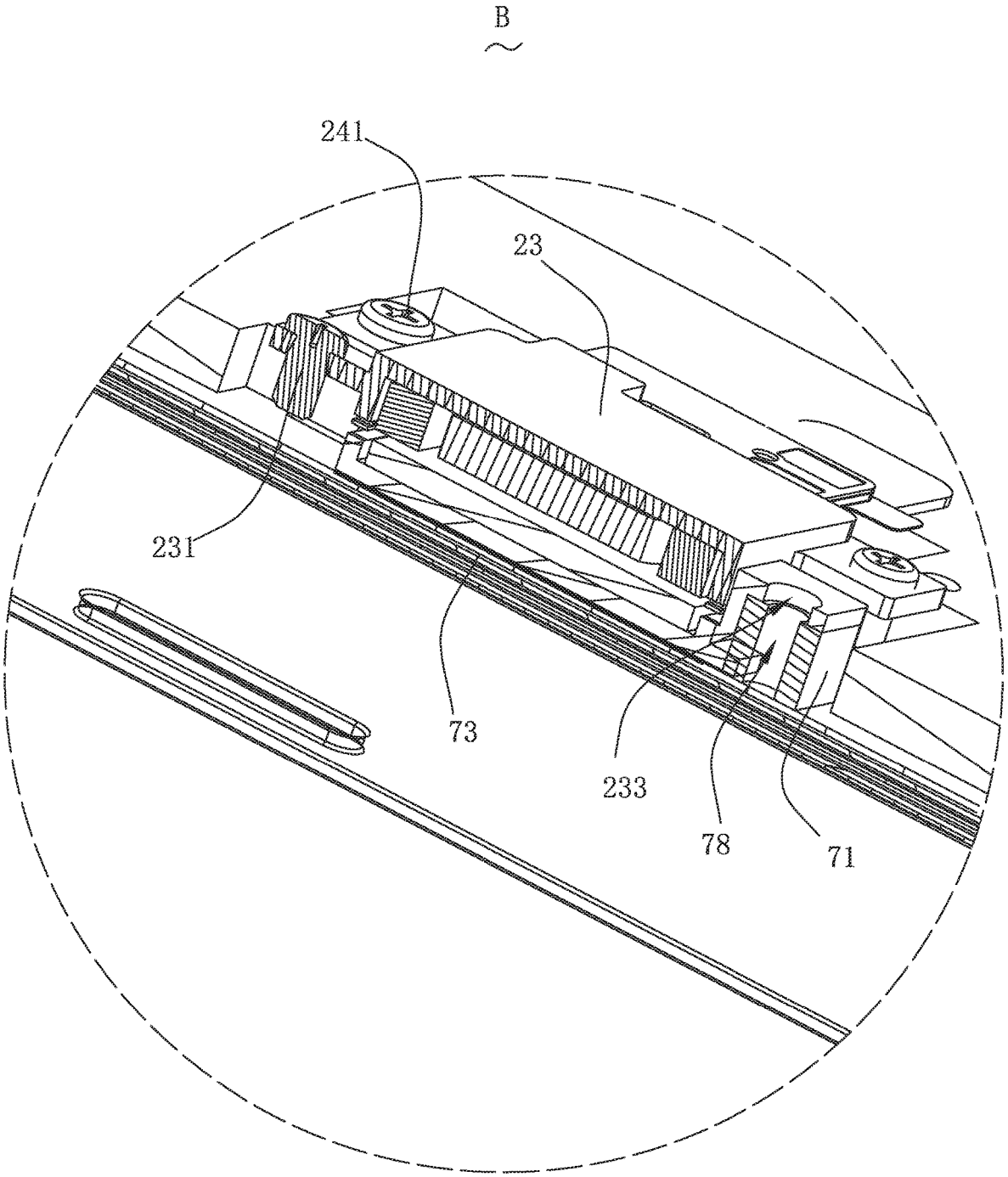
FIG. 13 is an enlarged view of the circle marked in FIG. 12.

FIG. 7 is a structural schematic view of the middle frame in the screen sound generation device provided in this embodiment, FIG. 10 is a structural schematic view of the screen sound generation device provided in Embodiment 2, and FIG. 11 is a sectional view taken along the line B-B of FIG. 10. Referring to FIG. 7, FIG. 10 and FIG. 11 together, the middle frame 3 is provided with a through opening 31 having a height greater than that of the limiting plate 4.

The middle frame 3 further includes a limit step 33. The steel sheet 73 is placed in the through opening 31 to form a receiving space 310. The limit step 33 is received in the receiving space 310, and the limiting step 33 has a height equal to that of the side plate 43.

The extension plate 45 is further provided with a fifth installation hole 450, the limit step 33 is provided with a sixth installation hole 330 corresponding to the fifth installation hole 450, and the limit plate 4 and the middle frame 3 are fixed together by a nut 241.

The screen sound generation device according to the present disclosure is fixed on the screen by a detachable fixing part such that a flexible assembly way is obtained, the difficulty of assembly is reduced, and the working efficiency is improved, and the structural integrity of the entire exciter in assembly can be ensured so as to avoid any damage, thereby ensuring the quality of the sound generation device.

The above shows and describes the embodiments of the present disclosure. It is understanble that the embodiments above are only examplary, and should not be interpreted as limiting the present disclosure, and those skilled in the art can make changes, modifications, replacements and deformations to the embodiments above within the scope of the present disclosure.

What is claimed is:

1. A screen sound generation device comprising:

a screen configured for vibrating and generating sound;

an exciter configured for driving the screen to vibrate and generate sound, a vibration direction of the exciter being perpendicular to the screen; and a middle frame configured for receiving and fixing the screen and the exciter;

wherein the screen sound generation device further comprises a fixing part by which the exciter is detachably fixed to a side of the screen; and the fixing part comprises a limit block with a threaded hole therein and a steel sheet attached to the screen, the limit block is fixed to the steel sheet, and the exciter is fixed to the steel sheet by a connecting structure with threads.

2. The screen sound generation device according to claim 1, wherein the steel sheet is fixed to the screen by double-sided adhesive or liquid adhesive.

3. The screen sound generation device according to claim 1, wherein the limit block is fixed to the steel sheet by welding or bonding.

4. The screen sound generation device according to claim 1, wherein the exciter comprises a yoke with a first installation hole defined at each end thereof, the middle frame comprises a notch for providing an access to the steel sheet and a second installation hole defined at a periphery of the notch and corresponding to the first installation hole, the exciter is received in the notch, and the yoke is fixed to the middle frame at each end by a nut.

5. The screen sound generation device according to claim 1, wherein the middle frame comprises a limit plate with a mounting opening, and a third installation hole is defined at a periphery of the mounting opening for fixing the exciter.

6. The screen sound generation device according to claim 5, wherein the exciter comprises a yoke with a fourth installation hole defined at each end thereof and corresponding to the third installation hole, and the exciter is fixed to the limit plate by a nut.

7. The screen sound generation device according to claim 5, wherein the middle frame is provided with a through opening having a height greater than that of the limit plate.

8. The screen sound generation device according to claim 7, wherein the limit plate comprises a bottom plate, side plates extending perpendicularly from opposite sides of the bottom plate to form an end opening, and an extension plate extending perpendicularly from a free end of each side plate in a direction away from the opening.

9. The screen sound generation device according to claim 8, wherein the middle frame comprises a limit step, the steel sheet is placed in the through opening to form a receiving space, the limit step is received in the receiving space.

10. The screen sound generation device according to claim 9, wherein the limit step has a height equal to that of the side plates.

11. The screen sound generation device according to claim 9, wherein the extension plate is further provided with a fifth mounting hole, the limit step is provided with a sixth mounting hole corresponding to the fifth mounting hole, and the limit plate and the middle frame are fixed together by a nut engaged in the fifth mounting hole and the sixth mounting hole.

* * * * *